US005108000A

United States Patent [19]

Stoll et al.

[11] Patent Number: 5,108,000

[45] Date of Patent: Apr. 28, 1992

[54] RECYCLABLE MATERIALS CADDY FOR HANGING ATTACHMENT TO A WASTE RECEPTACLE

[75] Inventors: Mark S. Stoll, Deephaven; Rebecca L. Waterston, Plymouth, both of Minn.

[73] Assignee: Liberty Diversified Industries, Minneapolis, Minn.

[21] Appl. No.: 543,944

[22] Filed: Jun. 26, 1990

[51] Int. Cl.[5] ..... B65D 21/02

[52] U.S. Cl. ..... 220/23.4; 220/23.86; 220/909; 229/117.09; 229/117.21; 229/164; 206/806

[58] Field of Search ..... 229/117.09, 117.21, 229/164; 220/23.83, 23.86, 23.4, 909, 908; 206/806

[56] References Cited

U.S. PATENT DOCUMENTS

| | | | |
|---|---|---|---|
| 391,283 | 10/1888 | Traut | 229/117.21 |
| 403,535 | 5/1889 | Johnson | 220/23.86 |
| 668,727 | 2/1901 | Chapman | 220/23.83 |
| 1,237,622 | 8/1917 | Dickinson | 220/23.83 |
| 1,948,932 | 2/1934 | McMickle | 220/23.83 |
| 2,597,468 | 5/1952 | Garrett | 220/23.83 |
| 2,612,308 | 9/1952 | Potts | 220/117.19 |
| 3,092,302 | 6/1963 | McDermott | 229/117.09 |
| 4,024,590 | 5/1977 | Wendt | 220/23.83 |
| 4,753,341 | 6/1988 | McIntyre | 229/164 |

FOREIGN PATENT DOCUMENTS

| | | | |
|---|---|---|---|
| 1193211 | 4/1959 | France | 229/117.09 |

*Primary Examiner*—Joseph Man-Fu Moy
*Attorney, Agent, or Firm*—Moore & Hansen

[57] ABSTRACT

A caddy for recyclable paper constructed from an irregular blank of corrugated plastic sheet material such as double-faced polyethylene, with a metal hanger allowing the caddy to be mounted on the rim of a conventional wastebasket. The carton includes an open top, a higher rear wall, lower front wall, and angled side walls. The ends of the hanger are received between a rear panel and rear foldover panel which are hingedly connected and folded into parallel abutting contact to form the rear wall, the central portion of the hanger extending upwardly through a slit formed between those panels. Fastening tabs extending from the rear panel are inserted through slots defined between one side wall panel and a side flap, and a reinforcing tab extending from the rear foldover panel prevents the top fastening tab from flexing. An ear panel extending from the side panel is folded to form the angled top edge of the side wall, and engages in a slot on the reinforcing tab to press the reinforcing tab against the top fastening tab, further preventing flexing of either the fastening or reinforcing tabs.

The two-bag tote container is constructed from a blank of double-faced corrugated plastic sheet material, and is dimensioned to receive two standard paper shopping bags. The two-bag tote container has a metal retaining rim extending around the periphery thereof forming handgrips, and a lid pivotally connected to the retaining rim utilizing a plurality of hinge flaps.

16 Claims, 6 Drawing Sheets

RECYCLABLE MATERIALS CADDY FOR HANGING ATTACHMENT TO A WASTE RECEPTACLE

BACKGROUND OF THE INVENTION

This invention relates generally to receptacles and containers for recyclable waste paper, and particularly to a caddy folded from a blank of corrugated polyethylene for hanging attachment on the outside rim of a conventional wastebasket or the two-bag tote container disclosed herein.

Receptacles for waste materials and for filing papers are known to the art, particularly those fabricated from blanks of corrugated cardboard or fiberboard and folded to an upright configuration. These receptacles or files include generally rectangular cartons or containers having front and rear walls in which the top edge of the rear wall is higher than the top edge of the front wall, with side walls inclined having inclined or angled top edges connecting the top edges of the front and rear walls. Various versions of these containers, files, and display boxes may also have dual-compartments and be fabricated from a single blank, each compartment having the same angled top openings Representative examples of these structures are shown in U.S. Pat. Nos. 36,200 to Woods; 1,770,618 to Lambert; 1,821,960 to Brooks; 3,172,530 to Grabosky; 3,208,583 to Kamps; and 4,736,837 to Brainard.

Also known are conventional wastebaskets and trash receptacles of many types, particularly those used in office and home settings. The wastebaskets are generally constructed from plastic, metal, or hard rubber, and are usually shaped as inverted truncated cones or tapered rectangles. Representative examples of common wastebaskets are shown in U.S. Pat. Nos. 3,300,082 to Patterson; 3,451,453 to Heck; 3,481,112 to Bourgeois; 3,760,975 to Nilsson; 3,800,503 to Maki; 4,319,694 to Nehrbass; 4,798,363 to Cortesi; 4,850,507 to Lemongelli; and 4,869,391 to Farrington.

Of particular interest, U.S. Pat. No. 4,364,490 to Lang discloses a rectangular refuse receptacle which may be attached to the wheeled rail structure containing a standard bucket. The refuse receptacle is hung on a bracket to be disposed near the rim of the bucket, and is used for the disposal of surgical sponges and similar instruments in an operating room.

It is also known to utilize a single-compartment carton having an angled top for the collection of papers to be recycled, with the container being positioned on the floor or a desktop near a conventional wastebasket or trash receptacle. One such carton is manufactured by the Waldorf Paper Co. of St. Paul, Minn., and is folded to a generally upright configuration from a planar prescored blank of corrugated cardboard. The Waldorf Paper Co. container is constructed from a generally rectangular blank having angled or cropped corners, thereby presenting a somewhat elongated octagonal shape.

The Waldorf Paper Co. single-compartment carton described above does present several disadvantages when used for recycling. First, since it must rest on a generally flat surface in order to maximize stability, it is usually placed on a desk or shelf near the user, or on the floor near a waste receptacle. If placed on a desk or shelf, it often takes up valuable work or storage space more conveniently used for other purposes. If placed on the floor, it can be inadvertently kicked or knocked over, and may be placed in a location where it is difficult to reach or see, and therefore infrequently used or not emptied. Since the carton is movable and may be placed in different locations by different workers, the person collecting the waste materials a part of the normal waste disposal or recycling program must look in different locations for the carton, or it may be missed during normal collections, thereby necessitating that the worker empty the contents the following day or resulting in the recyclable materials not being properly collected. The single rear wall construction of the carton makes it prone to being crushed or ripped during extended use, and the method of folding and fastening the carton in an upright configuration allows the carton to become fastened when overloaded or lifted improperly. The exposed bottom edges of the outer side walls of this carton can snag on carpeting if the carton is slid along the floor, such as when being moved by the foot of a worker, and the side panels will then become unfastened. If placed proximate to a waste receptacle, the carton can be damaged or degraded by other waste products, particularly food or liquid which may be spilled into the carton, and the carton cannot be cleaned. The single rear panel also presents a sharp corrugated top edge, which can cut a person attempting to grasp or lift the carton, particularly when filled with papers.

BRIEF SUMMARY OF THE INVENTION

It is therefore one object of this invention to design a caddy for recyclable waste paper materials that may be mounted in stable, hanging attachment on the rim of a conventional wastebasket, thereby providing for convenient use and collection.

It is a related object of this invention to design the above caddy for recyclable waste papers such that it may be utilized in combination with a two-bag tote container of a specialized design disclosed herein.

It is another object of this invention to design the above caddy for recyclable waste papers to be folded from a single blank of corrugated sheet material, and be of a predominantly reinforced construction.

It is another object of this invention to design the above caddy for recyclable waste papers such that it can support heavy loads either internally or externally, withstand impacts, be lifted by any wall without deforming or becoming unfastened, and be reused extensively.

Briefly described, the caddy for recyclable paper materials is constructed from an irregular blank of corrugated plastic sheet material such as double-faced polyethylene, with a metal hanger member allowing the caddy to be mounted in hanging relation to the rim of a conventional wastebasket. The carton includes an open top, with a higher rear wall, lower front wall, and angled side walls. The ends of the hanger member are received between a rear panel and a rear foldover panel which are hingedly connected and folded into parallel abutting contact to form the rear wall, and the central portion of the hanger member extends upwardly and rearwardly through a slit formed between those panels. Fastening tabs extending from the rear panel are inserted through slots defined between one side wall panel and a side flap, and a reinforcing tab extending from the rear foldover panel prevents the top fastening tab from flexing or puckering. An ear panel extending from the side panel is folded to form the angled top edge of the side wall, and engages in a slot on the reinforcing tab and presses the reinforcing tab against the top fastening tab, further preventing flexing or puckering of either the fastening or reinforcing tabs.

The two-bag tote container is similarly constructed from a blank of double-faced corrugated plastic sheet material, and is dimensioned to receive two standard paper shopping bags. The two-bag tote container has a metal retaining rim extending around the periphery thereof forming handgrips, and a lid pivotally connected to the retaining rim utilizing a plurality of hinge flaps.

DESCRIPTION OF THE PREFERRED EMBODIMENT

The recyclable materials caddy of this invention is shown in FIGS. 1-16 and referenced generally therein by the numeral 10.

Figure 1:
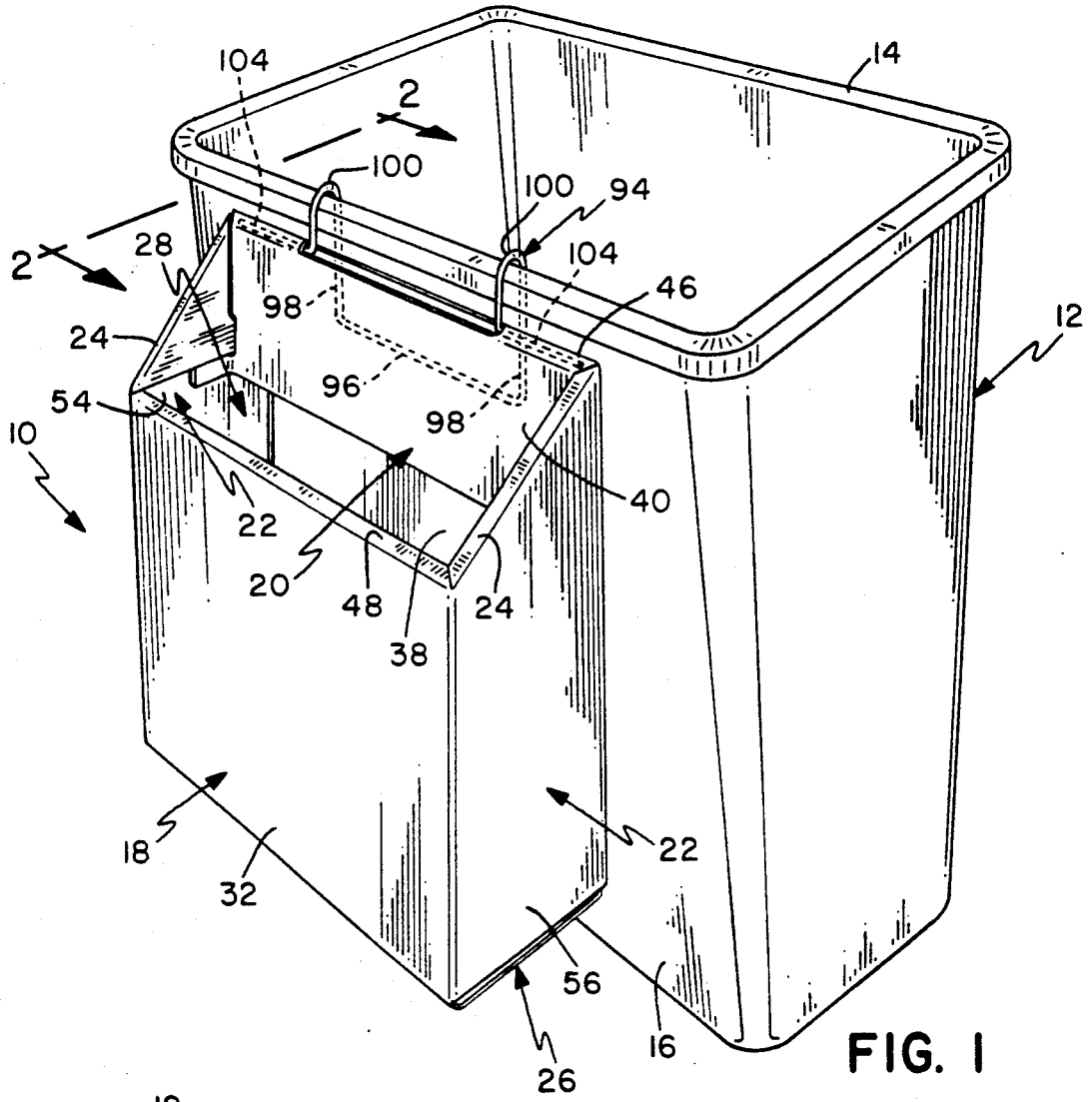
FIG. 1 is a front perspective view of the recyclable materials caddy of this invention in hanging attachment on a conventional wastebasket.

Referring particularly to FIG. 1, it may be seen that the caddy 10 may be mounted in hanging attachment on a conventional wastebasket 12, the caddy 10 being hung from the top peripheral rim 14 of the wastebasket 12 and disposed in front of and in generally parallel abutting contact with the exterior side of the front wall 16 of the wastebasket 12.

The caddy 10 has a body which includes a generally rectangular front wall 18, a generally rectangular rear wall 20 having a height greater than the height of the front wall 18, a pair of spaced-apart side walls 22 having forwardly angled finished top edges 24, and a generally rectangular bottom wall 26 which are connected together along the respective side and end edges thereof to form the generally upright structure of the caddy 10 defining an open top receptacle region 28 therein.

Figure 7:
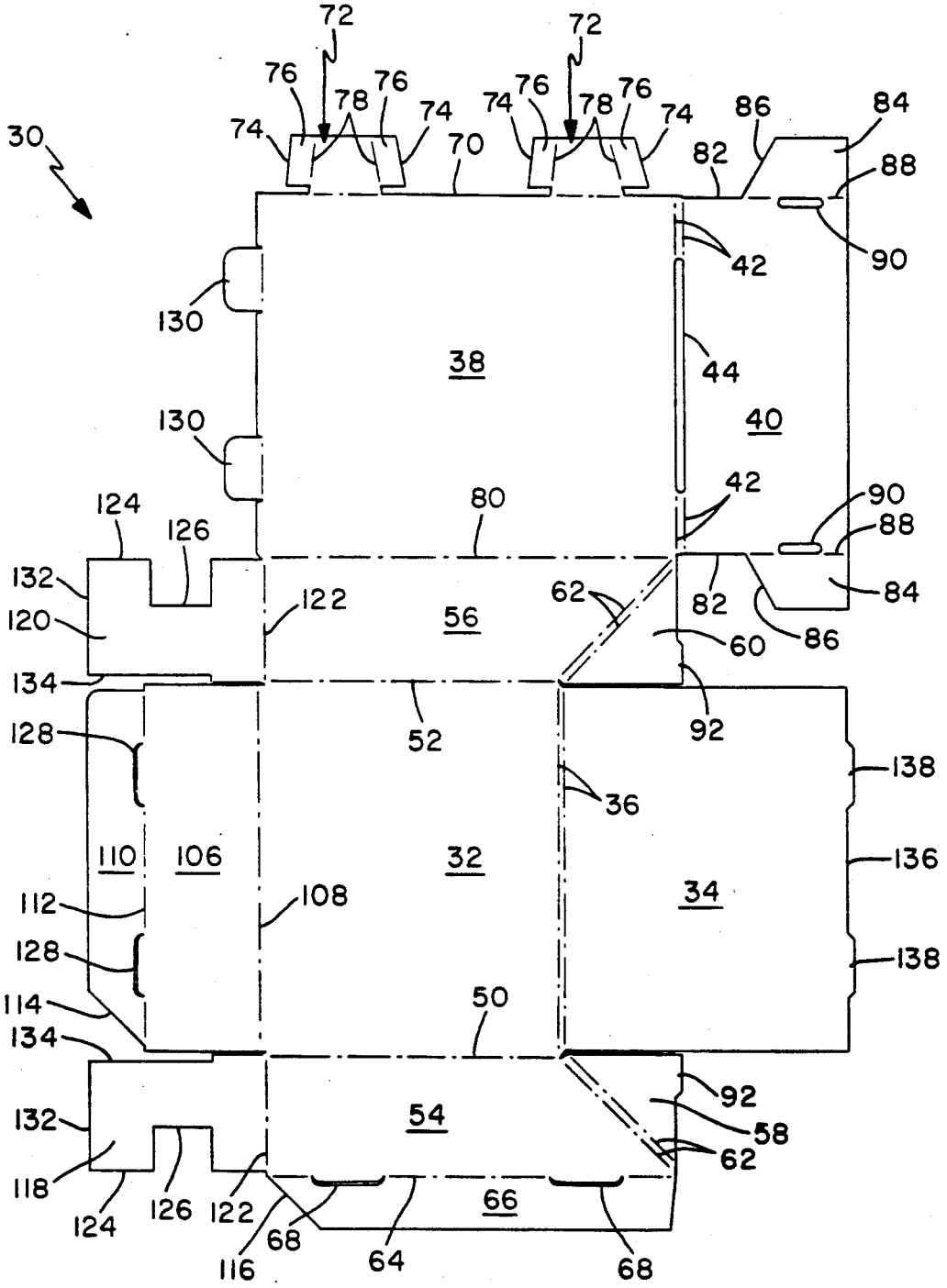
FIG. 7 is a top plan view of the blank used to construct the recyclable materials caddy of FIG. 1.

Referring to FIGS. 1 and 7, it may be seen that the caddy 10 is folded to an upright position from a generally planar blank 30 of plastic sheet material such as double-faced corrugated polyethylene, the blank 30 having an irregular, non-symmetric shape.

The front wall 18 is formed from a front panel 32 and front foldover panel 34 hingedly connected to one another along double-scored fold lines 36, and the rear wall 20 is formed from a rear panel 38 and rear foldover panel 40 hingedly connected to one another along double-scored fold lines 42. The rear panel 38 and rear foldover panel 40 also define an elongated slit 44 oriented along and parallel with the double-scored fold lines 42, such that the portion of the rear panel 38 and rear foldover panel 40 disposed between the double-scored fold lines 42 defines the finished top rear edge 46 of the caddy 10. Similarly, the portion of the front panel 32 and front foldover panel 34 disposed between the double-scored fold lines 36 defines the finished top front edge 48 of the caddy 10.

Extending from and hingedly connected to each side edge of the front panel 32 along single-scored fold lines 50, 52, respectively, are a left side panel 54 and right side panel 56. Each of the left and right side panels 54, 56 have a generally rectangular shape, each side panel 54, 56 defining a triangular-shaped ear flap 58, 60 extending from and hingedly connected thereto along double-scored fold lines 62 which are oriented upwardly and outwardly at an approximately 45° angle relative to the double-scored fold lines 36 separating the front panel 32 and front foldover panel 34, the inner or forward ends of the angled double-scored fold lines 62 intersecting the front edges of the side panels 54, 56 at points generally aligned with the double-scored fold lines 36. The portion of the left and right side panels 54, 56 disposed between the double-scored fold lines 62 define the finished and downwardly angled top side edges 24 of the caddy 10.

Extending from and hingedly connected to the rear edge of the left side panel 54 along a single-scored fold line 64 is a side foldover flap 66. The single-scored fold line 64 along which the side foldover flap 66 is connected to the left side panel 54 defines a pair of spaced-apart side securing slots 68, each side securing slot 68 having a generally straight length and curved ends. Hingedly connected to and extending from the free edge 70 of the rear panel 38 opposing the side foldover flap 66 are a pair of generally T-shaped side securing tabs 72, each side securing tab 72 having a pair of beveled or angled side edges 74, and a pair of foldable wing members 76 defined by and hingedly connected along single-scored fold lines 78 which extend parallel with the angled side edges 74. The wing members 76 are spaced closely proximate to the free edge 70 of the rear panel 38. The left side panel 56 is hingedly connected to the rear panel 38 by a single-scored fold line 80 such that the left side panel 56 is disposed between and parallel with the front panel 32 and rear panel 38.

Figure 6:
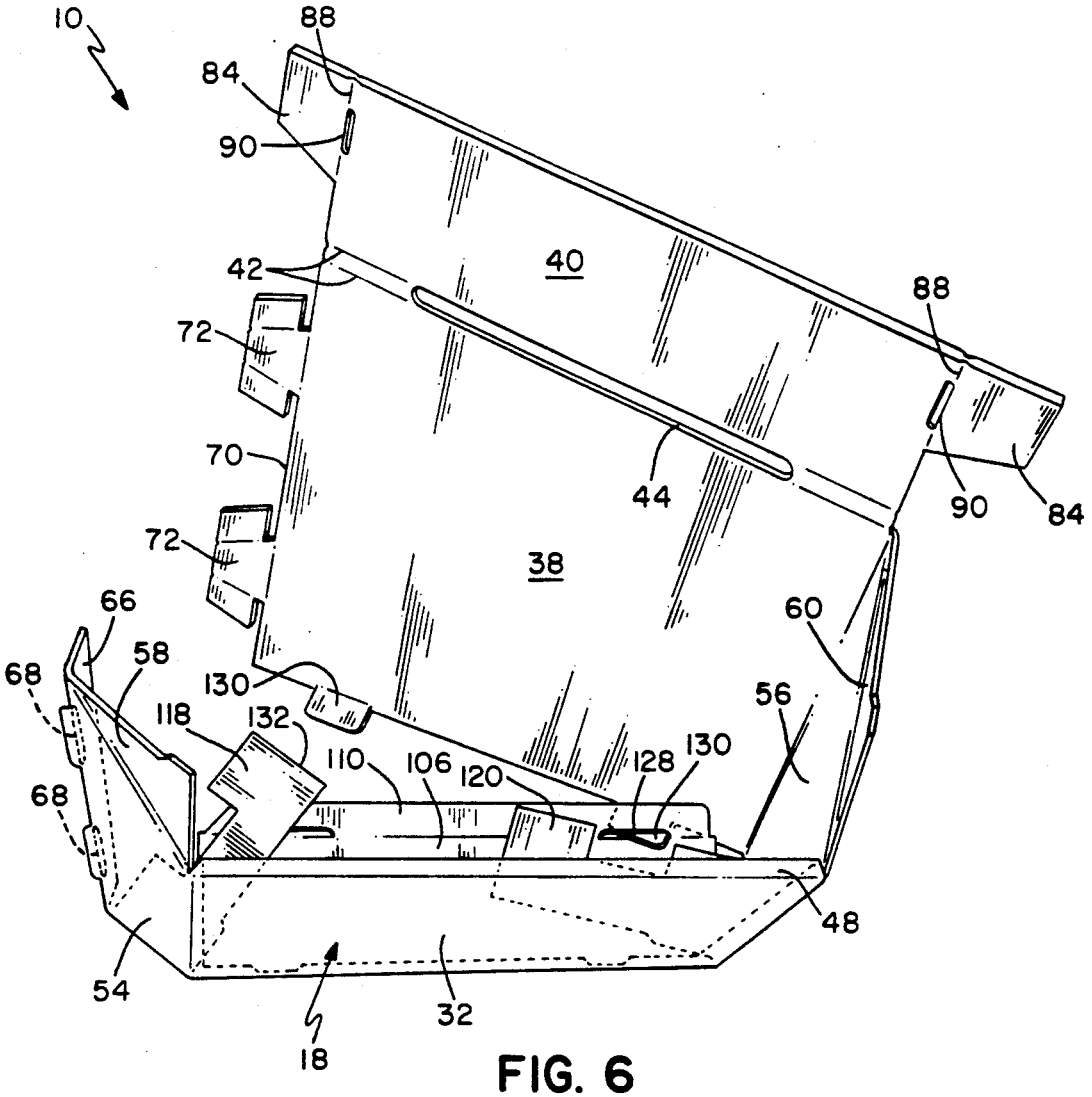
FIG. 6 is a top perspective view of the recyclable materials caddy of FIG. 1 with the rear panel and left side panel folded partially open.

Referring to FIG. 6, the caddy 10 is shown in the partially folded configuration, or conversely in the partially unfolded configuration. The rear panel is pivoted across the single-scored fold line 80, and the front panel 32 is pivoted across the single-scored fold line 52 relative to the right side panel 56. The left side panel 54 is similarly pivoted across the single-scored fold line 50 such that the free edge 70 is brought into close proximity to the single-scored fold line 64 adjacent the side foldover flap 66, and the T-shaped side securing tabs 72 being brought into close confronting proximity to the side securing slots 68.

Referring again to FIG. 7, it may be seen that extending outwardly from each side edge 82 of the rear foldover panel 40 are a pair of reinforcing tabs 84, each reinforcing tab 84 having a slightly angled bottom edge 86 and being hingedly connected to the rear foldover panel 40 along a single-scored fold line 88. The single-scored fold lines 88 along which the reinforcing tabs 84 are connected to the rear foldover panel 40 each define a retention slot 90, each retention slot 90 having a generally oblong shape.

Figure 3:
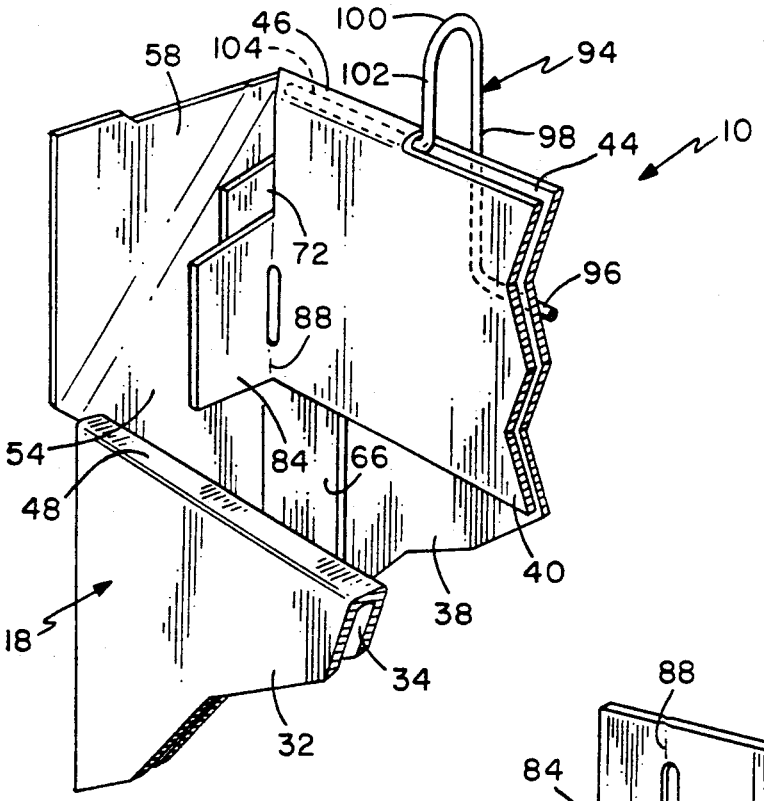
FIG. 3 is a partially broken away front perspective view of the recyclable materials caddy of FIG. 1 with the angled end flaps folded upwardly.
Figure 4:
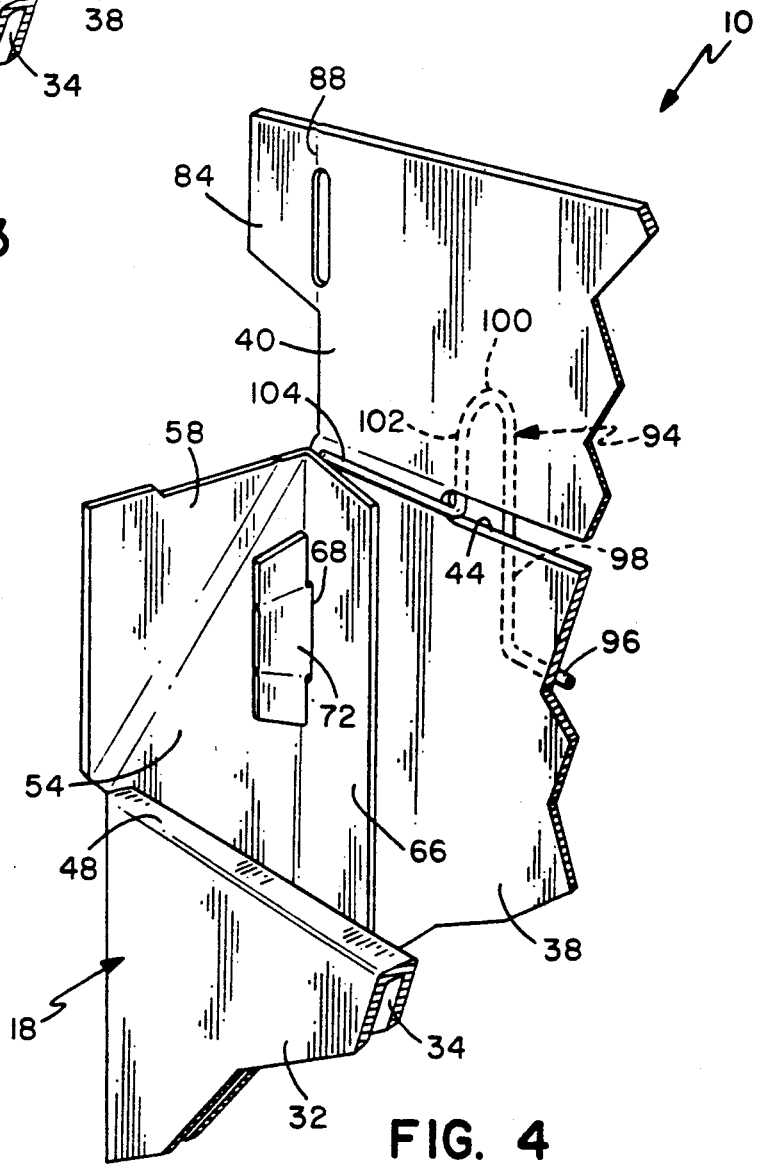
FIG. 4 is a partially broken away front perspective view of the recyclable materials caddy of FIG. 1 with the rear foldover panel folded upwardly.

Referring to FIGS. 3, 4, and 6, the caddy 10 is shown being folded to the upright folded configuration. In FIG. 3, the top portion of the caddy 10 is shown with the left triangular-shaped ear flap 60 folded upwardly, and in FIG. 4 with the rear foldover panel 40 folded upwardly. In FIGS. 3, 4, and 6, the front foldover panel 34 has been pivoted completely across the double-scored fold lines 36 so that the front foldover panel 34 is parallel to and closely confronting the front panel 32, and so that the top finished edge 48 of the front wall 18 is disposed upwardly. As shown in FIGS. 4 and 6, the side foldover flap 66 is folded across single-scored fold line 64 to a ninety-degree angle or lesser acute angle relative to the left side panel 54, and the side securing tabs 72 are then inserted through the corresponding side securing slots 68 from the exterior or outside surface of the left side panel 54 and side foldover flap 66.

Referring to FIG. 3, it may be seen that the rear foldover panel 40 is pivoted forwardly and downwardly across double-scored fold line 42 and into parallel alignment with the rear panel 38, and displaced therefrom by the side foldover flap 66. In so doing, the reinforcing tabs 84 are folded or bent inwardly across single-scored fold lines 88 to an approximately ninety degree angle, and parallel alignment with the right and left side panels 56, 54. The left reinforcing tab 84 disposed closest to the free side edge 70 of the rear panel 38 is thereby in parallel abutting contact with the inner surface of the topmost side securing tab 72, and exerts pressure against the topmost side securing tab 72 to prevent the topmost side securing tab 72 from flexing or puckering away from the left side panel 54.

Referring to FIGS. 1 and 7, it may be seen that the triangular-shaped ear flaps 58, 60 each define a narrow retention tab 92. When the triangular-shaped ear flaps 58, 60 are pivoted inwardly and downwardly across the corresponding double-scored fold lines 62, the retention tabs 92 are brought into close proximity to and partially but engagingly received within the adjacent retention slot 90. The triangular-shaped ear flaps 58, 60 thereby form the top angled finished edges 24 of the caddy 10, and press the rear foldover panel 40 rearwardly toward the rear panel 38. The left triangular-shaped ear flap 58 is also thereby in parallel abutting contact with the inner surface of the left reinforcing tab 84, and prevents the left reinforcing tab 84 from flexing or bending away from the topmost side securing tab 72.

Referring again to FIGS. 3 and 4, it should be noted that prior to folding the rear foldover panel 40 forwardly and downwardly toward the rear panel 38, a hanger member 94 must be inserted through the elongated slit 44 between the rear panel 38 and rear foldover panel 40. Referring to FIGS. 1, 3, and 4, it may be seen that the hanger member 94 is a unitary or integral rod bent to form a straight central section 96 having two opposing ends, a pair of upright legs 98 extending from each end of the straight central section 96 at approximately ninety degree angles and parallel to one another, a pair of half-circular loop segments 100 extending from the top ends of the upright legs 98 and orthogonal to both the upright legs 98 and straight central section 98, a pair of depending segments 102 each extending a short distance downwardly from one of the half-circular loop segments 100 and parallel to the upright legs 98, and a pair of end segments 104 each extending outwardly from the bottom ends of depending segments 102 and generally parallel with the straight central section 96. The upright legs 98 are each spaced apart a distance approximately equal to or slightly less than the length of the elongated slit 44.

Figure 2:
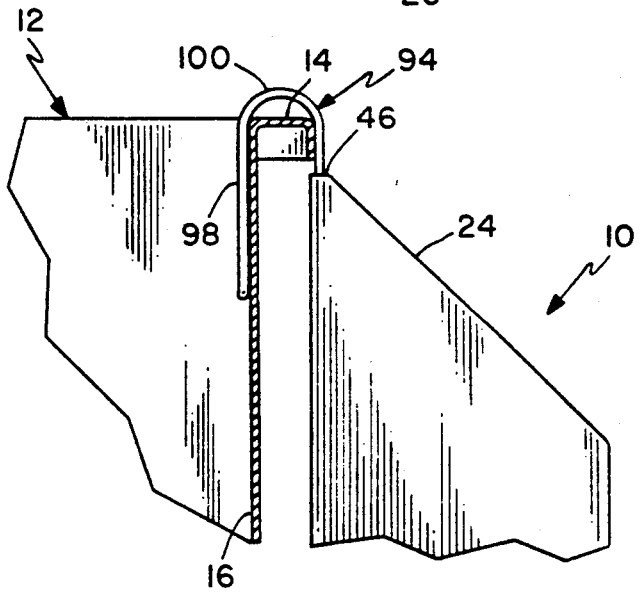
FIG. 2 is a partial side section view of the wastebasket and recyclable materials caddy taken through line 2—2 of FIG. 1.

The straight central section 96, upright legs 98, and loop segments 100 are received through the elongated slit 44 from the front or inner side of the rear panel 38, with the end segments 104 of the hanger member 94 being positioned between the rear panel 38 and the rear foldover panel 40 on the outer sides of the elongated slit 44. The straight central section 96, upright legs 98, and loop segments 100 define a support section projecting rearwardly from said rear wall 18 and a depending engagement section to support and secure the caddy 10 when the hanger member 94 is hangingly mounted on the rim 14 of a conventional wastebasket 12, as shown in FIGS. 1 and 2.

Referring again to FIG. 7, it may be seen that a bottom panel 106 extends from and is hingedly connected to the bottom edge of the front panel 32 along a single-scored fold line 108. A narrow bottom flap 110 extends from and is hingedly connected to the rear edge of the bottom panel 106 along a single-scored fold line 112. The left side edge 114 of the bottom flap 110 disposed furthest from the rear panel 30 is angled approximately forty-five degrees relative to the single-scored fold line 112, and the bottom edge 116 of the side foldover flap 66 is similarly angled approximately forty-five degrees relative to the single-scored fold line 64, such that the two edges 114, 116 will be parallel and confront and abut one another when the caddy 10 is folded to the upright configuration as shown in FIG. 1.

A pair of left and right inner bottom panels 118, 120 extend from and are hingedly connected to the bottom edges of each of the left and right side panels 54, 56, respectively, along single-scored fold lines 122. The front edge 124 of each of the left and right inner bottom panels 118, 120 define a generally rectangular notch or recess 126.

The single-scored fold line 112 along which the bottom panel 106 is connected to the bottom flap 110 defines a pair of spaced-apart bottom securing slots 128, each bottom securing slot 128 having a generally straight length and curved ends. Extending from and hingedly connected to the bottom edge of the read panel 38 are a pair of spaced-apart bottom securing tabs 130 each having rounded corners and widths approximately equal to the widths of the corresponding bottom securing slots 128.

Figure 5:
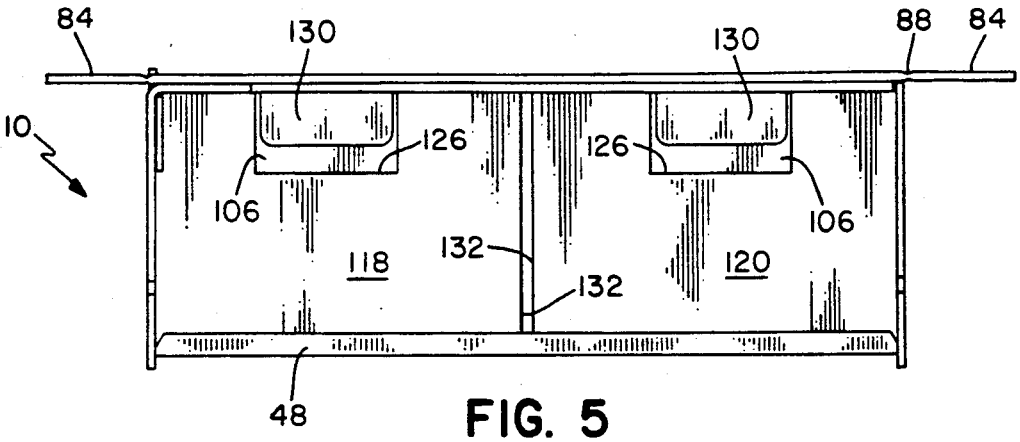
FIG. 5 is a top view of the recyclable materials caddy of FIG. 4 with the hanger member removed.

Once the front panel 32, rear panel 38, and side panels 54, 56 of the caddy 10 are folded to the upright configuration as shown in FIGS. 3, 4, and 6, with the side securing tabs 72 being inserted and engaged within the side securing slots 68, the left and right inner bottom panels 118, 120 are folded upwardly to a generally horizontal orientation lying parallel with the bottom edges of the front panel 32 and rear panel 38, with the center edges 132 of each of the left and right inner bottom panels 118, 120 being parallel to and closely confronting one another, as shown in FIG. 5. The bottom panel 106 is then folded upwardly parallel with and contacting the bottom surface of each of the left and right inner bottom panels 118, 120, the bottom flap 110 simultaneously being pivoted across the single-scored fold line 112 to an acute angle of ninety degrees or less and into a vertical orientation parallel with and contacting the inner surface of the rear panel 38. The bottom securing tabs 130 may then be slidably inserted into the bottom securing slots 128, each of the bottom securing tabs 130 being received within the area defined by the recesses 126 in the left and right inner bottom panels 118, 120, as shown particularly in FIG. 5. The bottom securing tabs 130 are thereby generally coplanar with the left and right inner bottom panels 118, 120, and rest directly above and in contact with the bottom panel 106.

The front edge of each of the left and right inner bottom panels 118, 120 define an elongated notch or recessed section 134 which are aligned and communicate with one another when the left and right inner bottom panels 118, 120 are folded upwardly to define the bottom of the caddy 10. Extending from and connected to the bottom edge 136 of the front foldover panel 34 are a pair of spaced apart locking tabs 138, each locking tab 138 having a depth measured from the bottom edge 136 approximately equal to the thickness of the double-faced corrugated plastic sheet material used to construct the caddy 10, on the order of one eighth of an inch.

When the front foldover panel 34 is folded into parallel alignment with the front panel 32, and the left and right inner bottom panels 118, 120 and bottom panel 106 are folded upwardly to enclose the bottom of the caddy 10, the locking tabs 138 are received and engaged within the elongated recessed section 134 defined by the front edges of the left and right inner bottom panels 118, 120, the locking tabs 138 contacting the left and right inner bottom panels 118, 120 along the elongated recessed section 134 thereof and thereby preventing the front foldover panel 34 from pivoting away from or out of parallel alignment with the front panel 32.

In operation, the recyclable materials caddy 10 is folded from the blank 30 as shown in FIG. 7 to the completely folded, upright configuration shown in FIG. 1 as described above, with the hanger member 94 being attached to the caddy 10 in the manner similarly described above. The caddy 10 may then be mounted in a stable, hanging attachment on the rim 14 of a conventional wastebasket 12 as shown particularly in FIG. 1 and 2. When waste materials (not shown)) are being discarded by a user into the conventional wastebasket 12, recyclable waste materials such as predetermined types of paper may be selectively placed within the caddy 10 mounted on the wastebasket 12. The caddy 10 may later be removed from the wastebasket 12, and the recyclable waste materials discarded into a bin or carrier for processing or recycling.

Alternately, the recyclable materials caddy 10 of this invention may be utilized with a "two-bag" tote container 140 shown in FIGS. 8–16. The two-bag tote container 140 is similarly constructed from one or more blanks of double-faced corrugated plastic sheet material, and is dimensioned to receive two standard paper shopping bags 142 which themselves have rectangular base dimensions of approximately seven inches by twelve inches and a height dimension of approximately thirteen inches, in a side-by-side relation within the interior region of the two-bag tote container 140. The two-bag tote container 140 has a metal retaining rim 144 extending around the top peripheral edge, and a pair of generally rectangular opposing side walls 146, 148 each defining opposing handgrip openings 150 through which the retaining rim 144 may be gripped. The two-bag tote container 140 includes a generally rectangular front wall 152 on which the caddy 10 may be mounted in hanging attachment, and a generally rectangular rear wall 154. The portion of each of the front wall 152, rear wall 154, and opposing side walls 146, 148 may be folded inwardly across double-scored fold lines and attached to the corresponding wall 152, 154, 146, or 148 to secure the retaining rim 144 thereto. A lid 156, including a planar top section 158 and four generally rectangular skirt portions 160 connected to the peripheral edge of the planar top section 158 and depending therefrom, is pivotally connected to the retaining rim 144 utilizing a plurality of hinge flaps 162. The caddy 10 is mounted on the front wall 152 at a height determined by the dimensions of the hanger member 94 such that the caddy 10 does not obstruct the lid 156 when the lid is moved to the closed position in covering relation to the interior region of the two-bag tote container 140.

As may be seen in FIGS. 10–16, each of the hinge flaps 162 is integrally or unitarily constructed from a downwardly depending rear or main leg 164 and an upwardly projecting inner leg 166 extending from and hingedly connected to the bottom end of the main leg 164.

Figure 10:
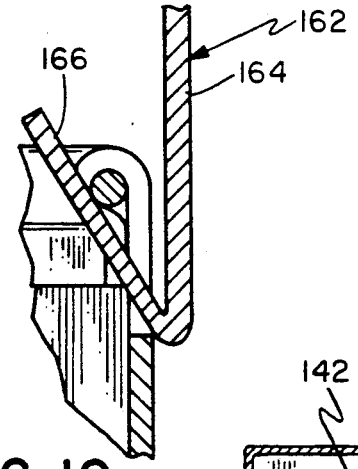
FIG. 10 is an enlarged side section view of the rear hinge construction of the lid of the two-bag tote container of FIG. 9 in the closed position.
Figure 11:
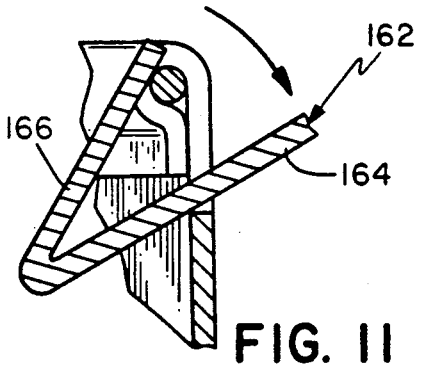
FIG. 11 is an enlarged side section view of the rear hinge construction of the lid of the two-bag tote container of FIG. 9 in the open position.
Figure 9:
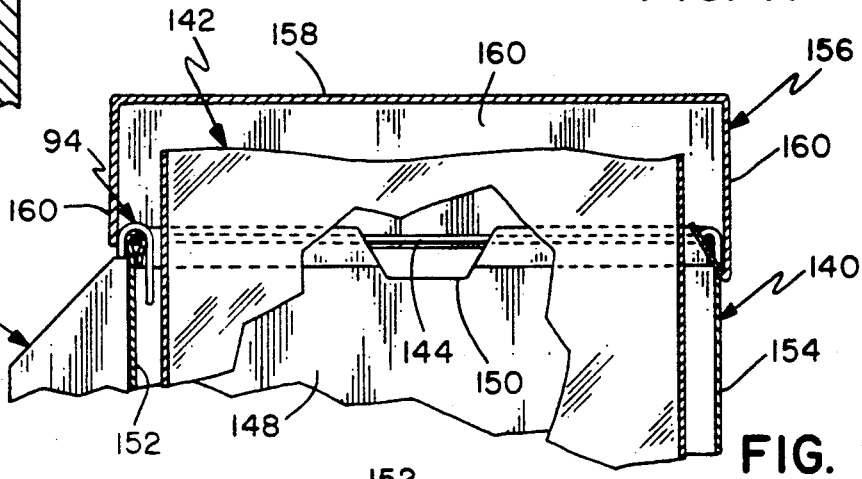
FIG. 9 is a side section view of the two-bag tote container and recyclable materials caddy of FIG. 8 taken through line 9—9 of FIG. 8.
Figure 8:
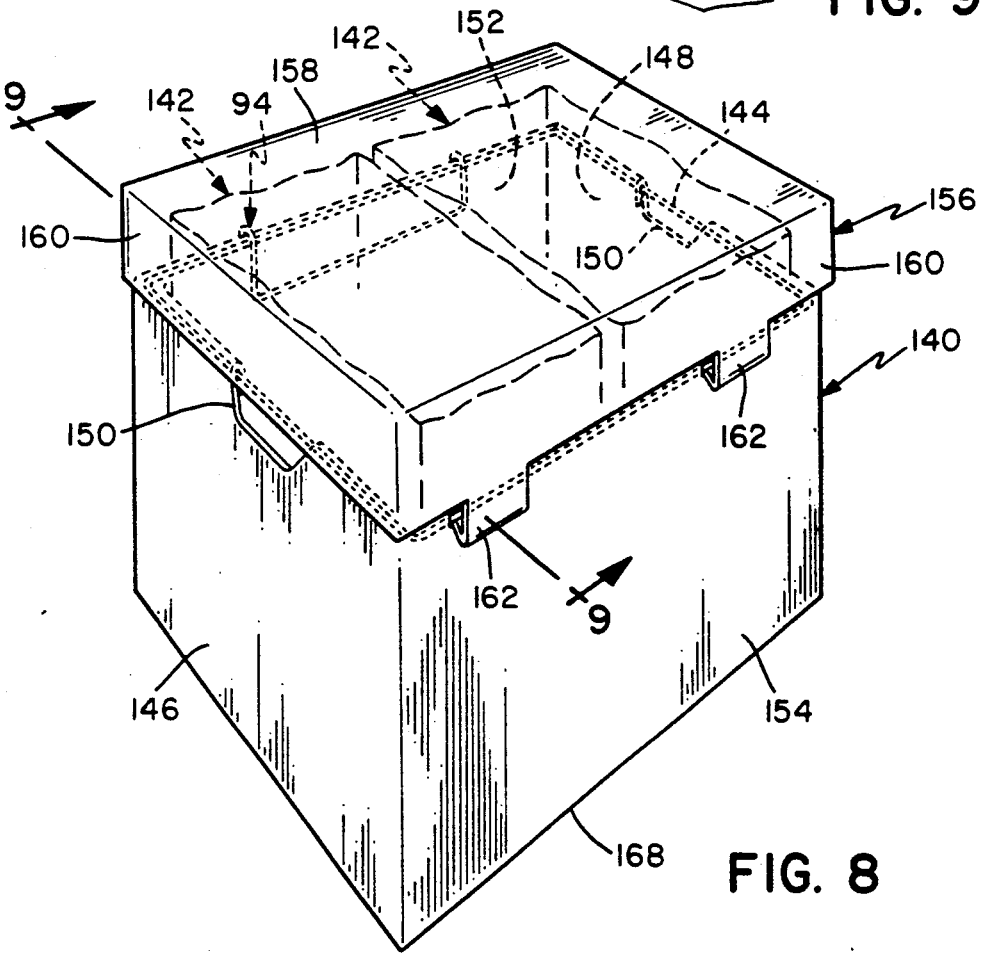
FIG. 8 is a rear perspective view of a two-bag tote container with a recyclable materials caddy of FIG. 1 in hanging attachment thereon.

FIGS. 10 and 11 show an open configuration of the hinge flaps 162 wherein the inner leg 166 is angled away from the main leg 164 at an acute angle and is not secured to the main leg 164. FIGS. 9 and 10 show the position of the hinge flaps 164 when the lid 156 is pivoted to the closed position in covering relation to the open top receptacle region of the two-bag tote container 140, the depending skirt portions 60 of the lid 156 extending to a point beneath or below the height of the top edges of the front wall 152, rear wall 154, and opposing side walls 146, 148 defined by the double-scored fold lines of the folded portion of each wall 152, 154, 146, and 148, respectively. Consequently, the height of the two-bag tote container 140 measured between the bottom panel 168 and the planar top section 158 of the lid 156 is such that the conventional paper bags 142 will not be crushed when the depending skirt portions 60 of the lid 156 extend to that point beneath or below the top edges of the front wall 152, rear wall 154, and opposing side walls 146, 148.

Figure 12:
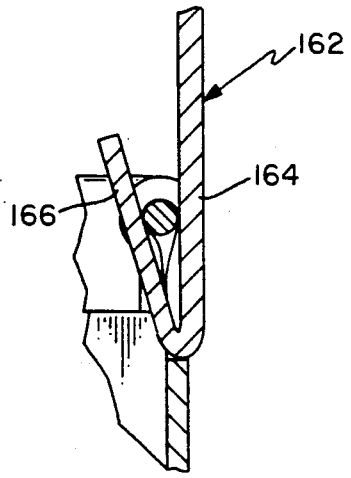
FIG. 12 is an enlarged side section view of an alternate crimped rear hinge construction for the lid of the two-bag tote container with the hinge member unfastened.
Figure 13:
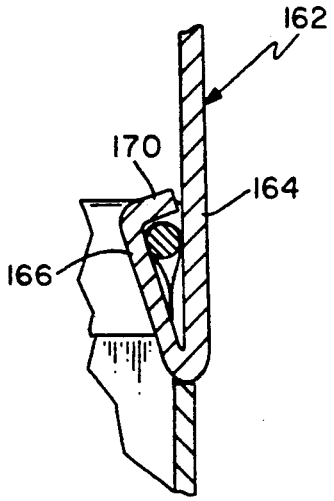
FIG. 13 is an enlarged side section view of the alternate rear hinge construction of FIG. 12 with the hinge member fastened.

FIGS. 12 and 13 show a crimped configuration of the hinge flaps 162 wherein the inner leg 166 is angled away from the main leg 164 at an acute angle as shown in FIG. 12, the top segment 170 of the inner leg 166 being crimped or bent back toward and into close proximity to the main leg 164 as shown in FIG. 13, again with the top segment 170 of the inner leg 166 not being secured to the main leg 164.

Figure 14:
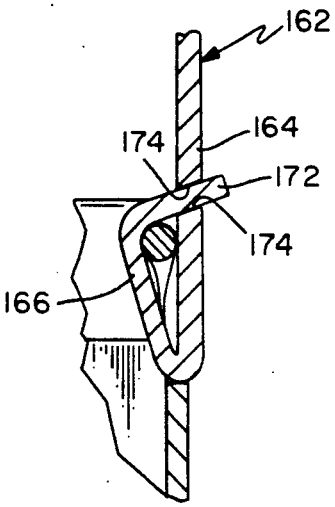
FIG. 14 is an enlarged side section view of an alternate tabbed rear hinge construction for the lid of the two-bag tote container with the hinge member unfastened.

FIG. 14 shows a tabbed configuration of the hinge flaps 162 wherein the inner leg 166 is angled away from the main leg 164 at an acute angle, the narrowed top half 172 of the inner leg 166 being crimped or bent back toward the main leg 164 and extending through a slot or aperture 174 defined by the main leg 164 to secure the inner leg 166 to the main leg 164. Alternately, both the main leg 164 and top half 172 of the inner leg 166 may be notched on opposing and confronting sides thereof, and the notches engaged with one another to secure the inner leg 166 to the main leg 164.

Figure 15:
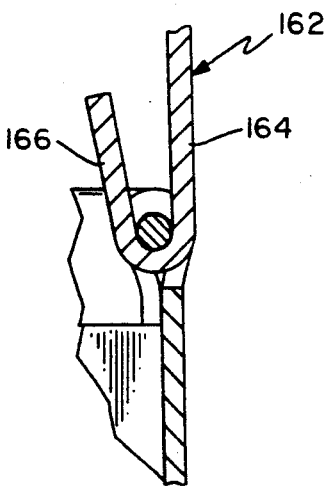
FIG. 15 is an enlarged side section view of an alternate sealed rear hinge construction for the lid of the two-bag tote container with the hinge member unfastened.
Figure 16:
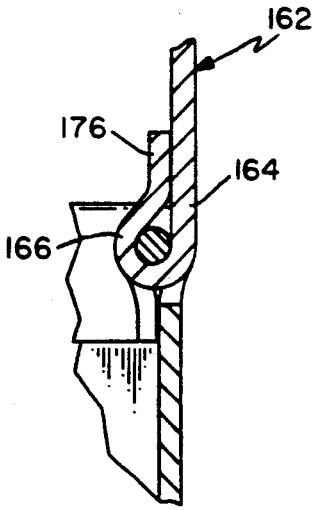
FIG. 16 is an enlarged side section view of the alternate sealed rear hinge construction of FIG. 15 with the hinge member fastened.

FIGS. 15 and 16 show a sealed configuration of the hinge flaps 162 wherein the top segment 176 of the inner leg 166 is pressed into parallel confronting contact with the inner surface of the main leg 164, and fixedly attached thereto using a fastening means such as sonic welding.

. In operation, the two-bag tote container 140 may contain a pair of bags 142 used to receive sorted waste materials such as aluminum, glass, or plastic, with one or more of the recyclable materials caddy 10 being mounted in hanging attachment on the front wall 152 of the two-bag tote container 140 to selectively receive sorted waste material such as paper.

While the preferred embodiment of the above recyclable materials caddy 10 and methods of using and constructing same have been described in detail above with reference to the attached drawing figures, it is understood that various changes and adaptations may be made without departing from the spirit and scope of the appended claims.

What is claimed is:

1. A caddy for mounting in hanging attachment on a rim of a wastebasket, said caddy comprising:

a caddy body, said caddy body being fabricated from a generally planar sheet material, said caddy body including a generally rectangular front wall having a height, a generally rectangular rear wall having a height greater than said height of said front wall, a pair of side walls connected to and extending between said front wall and said rear wall, each of said pair of side walls being spaced apart and having an angled top edge, and a generally rectangular bottom wall, said caddy body defining an open top receptacle region; and a hanger member, said hanger member being at least partially received through a portion of said rear wall and defining a support section projecting rearwardly from said rear wall of said caddy body and defining a depending engagement section, said hanger member being attached to said caddy body such that said caddy body may be mounted in hanging attachment on the rim of the wastebasket.

2. The caddy of claim 1 wherein the caddy body is folded to an upright configuration from a blank cut and scored from a generally planar sheet material, said blank comprising:

a front panel, said front panel having a pair of opposing side edges, a top edge, and a bottom edge, said front panel having a height;

a pair of side panels, each of said pair of side panels extending from and hingedly connected to said front panel along a one of said pair of opposing side edges thereof, each of said pair of side panels having an angled top edge and a bottom edge;

a rear panel, said rear panel extending from and hingedly connected to said a one of said pair of side panels, said rear panel having a top edge and a bottom edge and a free side edge, said rear panel having a height greater than said height of said front panel;

a front foldover panel, said front foldover panel extending from and hingedly connected to said front panel along said top edge thereof, said front foldover panel having a height approximately equal to said height of said front panel, said front foldover panel having a bottom edge, said front foldover panel being pivoted to a position generally parallel with said front panel when the caddy is folded to the upright configuration; and a rear foldover panel, said rear foldover panel extending from and hingedly connected to said rear panel along said top edge thereof, said rear foldover panel having a height substantially less than said height of said rear panel, said rear foldover panel being pivoted to a position generally parallel with said rear panel when the caddy is folded to the upright configuration.

3. The caddy of claim 2 wherein the blank further comprises:

a bottom panel, said bottom panel extending from and hingedly connected to the front panel along the bottom edge thereof, said bottom panel having a rear edge;

a bottom flap, said bottom flap extending from and hingedly connected to the bottom panel along the rear edge thereof, said bottom flap being pivoted upwardly and at least partially received within the open top receptacle region when the caddy body is folded to the upright configuration, said bottom flap defining a pair of bottom securing slots extending entirely therethrough and being spaced apart a distance; and a pair of bottom securing tabs, said pair of bottom securing tabs extending from and being hingedly connected to the rear panel along the bottom edge thereof, said pair of bottom securing tabs being spaced apart a distance equal to said distance said pair of bottom securing slots are spaced apart, each of said pair of bottom securing tabs being slidably received within one of said pair of bottom securing slots when the caddy body is folded to the upright configuration to secure the bottom panel.

4. The caddy of claim 3 wherein the bottom flap has a pair of opposing side edges, a one of said pair of opposing side edges disposed furthest from the rear panel being angled approximately forty five degrees relative to a line along which the bottom flap is connected to the bottom panel.

5. The caddy of claim 3 wherein the blank further comprises:

a pair of inner bottom panels, each of said pair of inner bottom panels extending from and hingedly connected to one of the side panels along the bottom edge thereof, said pair of inner bottom panels being oriented parallel with the bottom panel and disposed above and in contact with the bottom panel when the caddy body is folded to the upright configuration, each of said pair of inner bottom panels having a rear edge, each of said pair of inner bottom panels defining a recessed area adjacent said rear edge thereof, each said recessed area being spaced apart from one another and receiving one of the pair of bottom securing tabs when the caddy body is folded to the upright configuration.

6. The caddy of claim 3 wherein the blank further comprises:

a pair of inner bottom panels, each of said pair of inner bottom panels extending from and hingedly connected to one of the side panels along the bottom edge thereof, said pair of inner bottom panels being oriented parallel with the bottom panel and disposed above and in contact with the bottom panel when the caddy body is folded to the upright configuration, each of said pair of inner bottom panels having a front edge, each of said pair of inner bottom panels defining a recessed section adjacent said front edge thereof, each said recessed section engagingly receiving a portion of the front foldover panel adjacent the bottom edge thereof when the caddy body is folded to the upright configuration.

7. The caddy of claim 6 wherein the blank further comprises:

a pair of locking tabs, said locking tabs extending from and connected to the front foldover panel along the bottom edge thereof, each said pair of locking tabs being engagingly received within a one of said recessed sections of said pair of inner bottom panels when the caddy body is folded to the upright configuration.

8. The caddy of claim 2 wherein the blank further comprises:

a side foldover flap, said side foldover flap extending from and hingedly connected to a one of the pair of side panels opposing the one of the pair of side panels from which the rear panel extends and is hingedly connected, said side foldover flap being pivoted rearwardly and at least partially received within the open top receptacle region when the caddy body is folded to the upright configuration, said side foldover flap defining at least one side securing slot extending entirely therethrough; and at least one side securing tab, said side securing tab extending from and being hingedly connected to the free side edge of the rear panel, said side securing tab being pivoted to a position generally parallel with and closely confronting said one of the pair of side panels from which the side foldover flap extends and is hingedly connected, said side securing tab being at least partially received within said side securing slot when the caddy body is folded to the upright configuration.

9. The caddy of claim 8 wherein the rear foldover panel has a side edge disposed closest to a free side edge of the rear panel, said blank further comprising:

at least one reinforcing tab, said reinforcing tab extending from and being hingedly connected to the side edge of the rear foldover panel disposed closest to the free side edge of the rear panel, said reinforcing tab being pivoted to a position generally parallel with and contacting the side securing tab when the caddy body is folded to the upright configuration, said reinforcing tab exerting pressure against the side securing tab to prevent the side securing tab from flexing or puckering away from the one of the pair of side panels from which the side foldover flap extends and is hingedly connected.

10. The caddy of claim 9 wherein the blank further comprises:

a pair of ear flaps, each of said ear flaps extending from and hingedly connected to one of the pair of side panels along the top edge thereof, each of said pair of ear flaps being pivoted downwardly and received within the open top receptacle region when the caddy body is folded to the upright configuration, at least a portion of said pair of ear flaps contacting and pressing rearwardly against the rear foldover panel to secure the rear foldover panel generally parallel with the rear panel.

11. The caddy of claim 10 wherein the rear foldover panel defines a pair of retention slots, and wherein the ear flaps further define a pair of retention tabs disposed adjacent to the rear foldover panel when the caddy body is folded to the upright configuration, said pair of retention tabs being received within said pair of retention slots when the caddy body is folded to the upright configuration.

12. The caddy of claim 11 wherein one of the retention slots is disposed closely proximate to the reinforcing tab, a one of the pair of ear flaps being positioned parallel with and contacting the reinforcing tab when the caddy body is folded to the upright configuration, said one of the pair of ear flaps exerting pressure against the reinforcing tab to prevent the reinforcing tab from flexing or puckering away from the side securing tab.

13. The caddy of claim 2 wherein the rear foldover panel or the rear panel defines an elongated slit, the hanger member further comprising:

a pair of end segments, each of said pair of end segments extending outwardly from the support section and generally parallel with the rear wall, said pair of end segments being disposed and engagingly received between the rear foldover panel and the rear panel, wherein the depending engagement section of the hanger member is received through the elongated slit.

14. A caddy and tote container assembly comprising:

a caddy body, said caddy body being fabricated from a generally planar sheet material, said caddy body including a generally rectangular front wall having a height, a generally rectangular rear wall having a height greater than said height of said front wall, a pair of side walls connected to and extending between said front wall and said rear wall, each of said pair of side walls being spaced apart and having an angled top edge, and a generally rectangular bottom wall, said caddy body defining an open top receptacle region;

a hanger member, said hanger member being at least partially received through a portion of said rear wall and defining a support section projecting rearwardly from said rear wall of said caddy body and defining a depending engagement section; and a tote container, said tote container having a front wall, a rear wall, a pair of opposing side walls, and a bottom panel, said tote container defining an interior region, said front wall of said tote container having a top edge, said hanger member being attached to said caddy body such that said caddy body may be selectively and removably mounted in having attachment on said top edge of said front wall of said tote container.

15. The caddy and tote container assembly of claim 14 wherein the tote container further includes a lid pivotably connected to the rear wall of the tote container and pivotable to a closed position in covering relation to the interior region of the tote container, and wherein the support section of the hanger member is disposed above and contacts the top edge of the front wall of the tote container, and the depending engagement section of the hanger member is at least partially disposed within the tote container such that the caddy body does not obstruct said lid when said lid is pivoted to said closed position.

16. The caddy and tote container assembly of claim 14 wherein the bottom panel of the tote container is dimensioned such that a pair of generally rectangular standard paper bags may be selectively and removably placed in a side-by-side relation within the interior region of the tote container.

* * * * *

UNITED STATES PATENT AND TRADEMARK OFFICE

CERTIFICATE OF CORRECTION

PATENT NO. : 5,108,000

DATED : April 28, 1992

INVENTOR(S) : Mark S. Stoll and Rebecca L. Waterston

It is certified that error appears in the above-identified patent and that said Letters Patent is hereby corrected as shown below:

Column 2, Line 15, delete "fastened" and substitute --unfastened-- therefor.

In claim 14, Column 13, Line 4, delete "having" and substitute --hanging-- therefor.

Signed and Sealed this

Fourteenth Day of September, 1993

Bruce Lehman

*Attest:*

BRUCE LEHMAN

*Attesting Officer*

*Commissioner of Patents and Trademarks*